US008308204B2

(12) United States Patent
Lindgren et al.

(10) Patent No.: US 8,308,204 B2
(45) Date of Patent: Nov. 13, 2012

(54) WINDOW SECURING MEANS AND METHODS

(75) Inventors: Claes Lindgren, Farum (DK); Torben Allesen Pedersen, Horsens (DK)

(73) Assignee: VKR Holding A/S, Horsholm (DK)

( * ) Notice: Subject to any disclaimer, the term of this patent is extended or adjusted under 35 U.S.C. 154(b) by 1134 days.

(21) Appl. No.: 11/996,314

(22) PCT Filed: Jul. 15, 2006

(86) PCT No.: PCT/EP2006/006959

§ 371 (c)(1),
(2), (4) Date: Jul. 15, 2008

(87) PCT Pub. No.: WO2007/009685

PCT Pub. Date: Jan. 25, 2007

(65) Prior Publication Data

US 2009/0146436 A1 Jun. 11, 2009

(30) Foreign Application Priority Data

Jul. 22, 2005 (EP) ..... 05015962

(51) Int. Cl.
*E05C 1/06* (2006.01)
*E05C 19/16* (2006.01)

(52) U.S. Cl. .. 292/144; 292/1; 292/251.5; 292/DIG. 20; 292/DIG. 31; 292/DIG. 47; 49/394

(58) Field of Classification Search ..... 292/1, 144, 292/251.5, 279, 336.3, DIG. 20, DIG. 31, 292/DIG. 47; 49/394
See application file for complete search history.

(56) References Cited

U.S. PATENT DOCUMENTS

| | | | | |
|---|---|---|---|---|
| 2,797,655 | A * | 7/1957 | Morehouse | 109/63.5 |
| 2,877,041 | A * | 3/1959 | Foley | 292/251.5 |
| 3,288,511 | A * | 11/1966 | Tavano | 292/251.5 |
| 3,481,076 | A * | 12/1969 | Bedard | 49/279 |
| 4,929,005 | A * | 5/1990 | Heinen | 292/251.5 |
| 6,062,614 | A * | 5/2000 | Petzold | 292/336.3 |
| 6,343,817 | B1 * | 2/2002 | Watanabe | 292/216 |
| 6,598,913 | B2 * | 7/2003 | Meinke | 292/336.3 |
| 6,644,072 | B1 * | 11/2003 | Hsieh | 70/107 |
| 6,698,262 | B2 * | 3/2004 | Wittwer | 70/208 |
| 6,765,330 | B2 * | 7/2004 | Baur | 310/103 |

(Continued)

FOREIGN PATENT DOCUMENTS

CN 2435493 Y 6/2001

(Continued)

*Primary Examiner* — Carlos Lugo
(74) *Attorney, Agent, or Firm* — K. David Crockett, Esq.; Niky Economy Syrengelas, Esq.; Crockett & Crockett, PC

(57) ABSTRACT

An assembly for securing an openable aperture closure member (11) in closed position relative to an aperture defines by a main frame (12), the aperture closure member (11) including a mechanically rotational element (24, 44, 54) for securing said closure member (11) to the frame (12), the assembly for securing comprising a push and/or pull actuation assembly (35) for easing the securing and/or releasing process for the aperture closure member, the actuation assembly including a handle bar (26) and at least one connecting member (37) which operably connects the handle bar (36) to the mechanical element (24, 44, 54); wherein the push and/or pull actuation assembly (35) is adapted to be translationally movable by an operator and the connecting member (37) is adapted to convert translational movement of the actuation assembly (35) into rotational forcing movement of the mechanically rotational element (24, 44, 54).

6 Claims, 12 Drawing Sheets

U.S. PATENT DOCUMENTS

| | | | | |
|---|---|---|---|---|
| 7,267,378 | B2 * | 9/2007 | Drumm | 292/251.5 |
| 7,393,023 | B1 * | 7/2008 | Kelly | 292/144 |
| 2004/0026933 | A1 | 2/2004 | Smith | |
| 2004/0189018 | A1 | 9/2004 | Geringer et al. | |

FOREIGN PATENT DOCUMENTS

| | | | |
|---|---|---|---|
| DE | 3427178 | A1 * | 2/1986 |
| DK | 168406 | B1 | 3/1994 |
| EP | 0792991 | A1 | 3/1997 |
| EP | 1099810 | A1 * | 5/2001 |
| EP | 1445403 | A1 | 11/2004 |
| FR | 2769036 | A1 | 2/1999 |
| GB | 2123472 | A | 2/1984 |
| JP | 49062250 | | 9/1947 |
| JP | 52154320 | | 5/1951 |
| JP | 62225671 | | 10/1987 |
| JP | 03295991 | | 12/1991 |
| JP | 08-326394 | | 12/1996 |
| JP | 08326394 | | 12/1996 |
| JP | 09-041775 | | 2/1997 |
| JP | 09041775 | | 2/1997 |
| JP | 11-125049 | | 5/1999 |
| JP | 11-509285 | | 8/1999 |
| WO | WO9704206 | | 2/1997 |
| WO | WO0196699 | A1 | 12/2001 |
| WO | WO02053863 | A1 | 7/2002 |
| WO | WO03048487 | A1 | 6/2003 |
| WO | WO2004063498 | A1 | 7/2004 |

* cited by examiner

WINDOW SECURING MEANS AND METHODS

The present invention relates to securing and/or locking devices and/or methods used, for example, but not exclusively, in a pivotable window, the securing/locking devices and methods being of a type having a push/pull activation member, the push/pull member activating either or both a rotatable hooking member and/or a magnetic securing and/or locking force to alternately secure and/or lock, and then release a movable closure member within a stationary aperture frame, such as a pivotable window sash in a stationary window frame.

BACKGROUND ART

Pivoting windows or other aperture closure members are well known and are widely used in walls or ceilings or roofs of buildings, inter alia. A locking mechanism arranged at an edge or end of the sash of a window or other aperture closure member is often used to prevent the sash from being opened unintentionally.

In various previous instances, as is described for example in EP1445403 and WO0196699, locking systems for windows, doors or the like, often included a movable locking member such as a pawl, a ratchet or the like, for cooperating with a striker plate, said striker plate having a recess, slot or the like for cooperating with the locking member in a locking position. To prevent break-ins etc., the locking member may often feature means for locking the locking member in relation to the striker plate, and said means, which may be a boss or an indentation, may have been designed to engage with a part of the striker plate. Other locking assemblies have also been described, as for example in WO03048487 or WO02053863 where a rotatable or swivellable handle has a locking member designed to pivotally engage a respective projection on a window frame or sash to lock the window in closed position.

Still further locking assemblies have included such as in WO04063498 which involves a lock assembly, especially for locking a window, a door or the like, comprising a base member, an operating member pivotally connected to the base member, a link member pivotally connected to the base member, a latch pivotally connected to both the link member and the operating member, said operating member being provided with a pivotable elongated handle bar having a first side facing the operating member. DK patent no. 168406 also discloses a lock assembly of the above type. A still further pivotable elongated handle bar lock actuating device is disclosed in EP0792991.

However, the designs of these or like prior lock mechanisms could be improved, particularly when it comes to ergonomics, and/or other effects on or undesirable results of manual manipulations in operation. Often, prior art designs require the application of substantial manual forces to engage and secure or even to release the respective locking mechanisms thereof, particularly in those window constructions which include a resiliently compressible, hermetically sealing gasket provided between the frame and the sash. Such gaskets can require large forces for manipulation and/or can create a jarring, thus often disagreeable release effect to the operator. It is hence an object of the invention to provide a lock assembly having improved functionality with respect to ergonomics and simplicity in use.

DISCLOSURE OF THE INVENTION

On this background, it is an object of the present invention to provide an openable closure member such as a door or window with improved ergonomic characteristics, particularly in alternately opening and then securing them in closed position. One or more of these objects may be achieved in accordance with claim 1 by providing a window or other openable aperture closure member with a push and/or pull actuation member as for example in the form of a handle bar. Such an actuation member eases the closing and locking process and/or contrarily simplifies the opening process.

Such a push/pull actuation member may be made useful with a rotatable hooking member and/or with a securing device of a type involving a rotatable magnetic field which is rotatable within a substantially stationary magnetic field, the rotatable and stationary magnetic fields being cooperative with each other to alternately securely hold, and then release a movable part within a stationary frame, as for example, a pivotable window sash in a stationary window frame.

Alternatively, a magnetic locking/securing relationship may be used without a push/pull member, rather activated by a rotatable switch member, or electronic switch, or even by remote control.

In addition to the magnetic locking means for locking the sash structure to the frame structure, an auxiliary locking means for locking the sash structure to the frame structure may be included regardless the actuation means, whether elongated handle or rotatable or electronic switch.

Further objects, features, advantages and properties of a pivot window and actuation members and/or securing and/or locking devices according to the invention will become apparent from the detailed description.

BRIEF DESCRIPTION OF THE DRAWINGS

In the following detailed portion of the present description, the invention will be explained in more detail with reference to the preferred embodiments shown in the drawings, in which.

DETAILED DESCRIPTION

Figure 1:
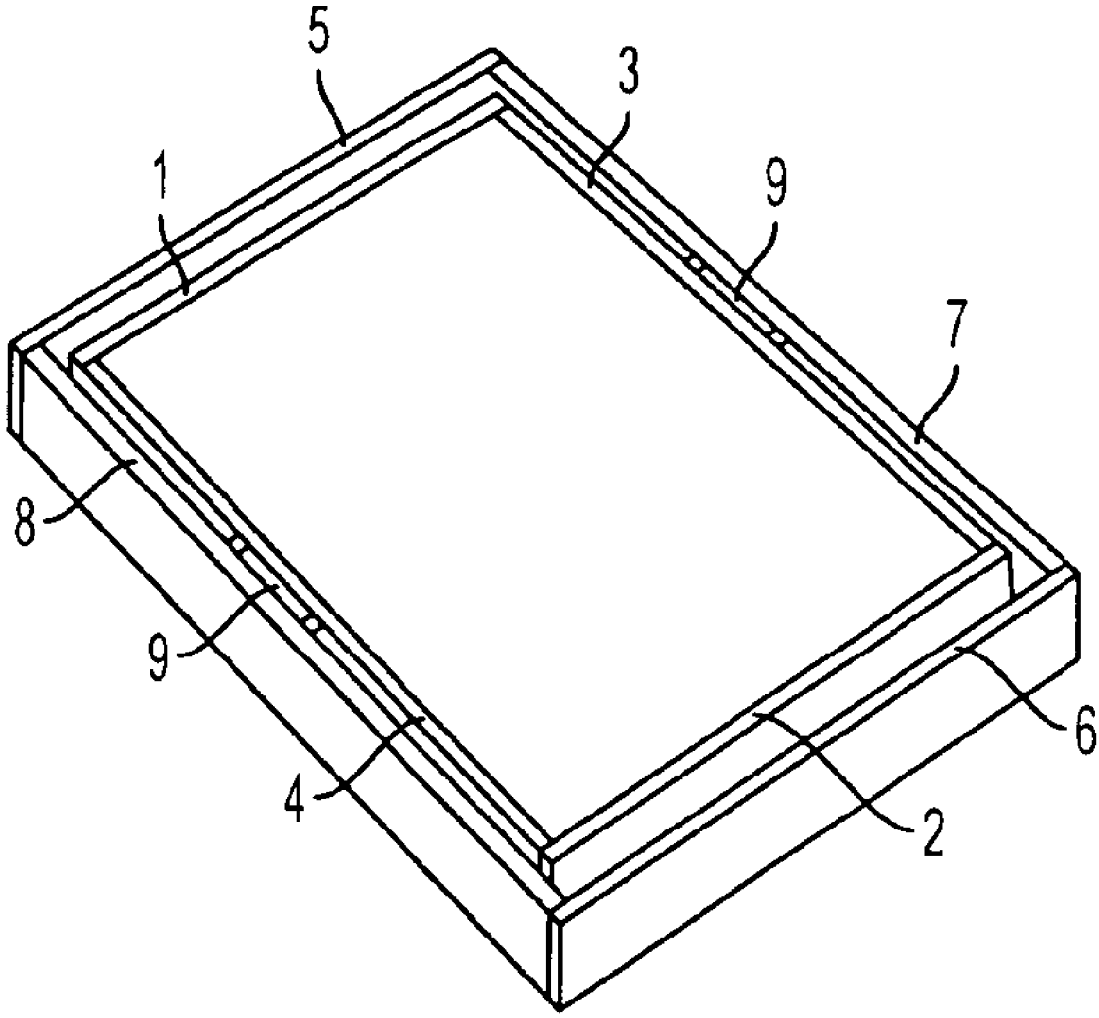
FIG. 1 is an isometric view of an embodiment of a pivotal window according to the invention in a closed position.

The present invention relates generally to securing devices or systems for an aperture closure member, such as a window or a door, the primary securing systems including a push and pull actuation member for activating the respective securing device or devices, the primary securing devices including either or both a rotatable hook and/or a magnetically activatable assembly. Such a magnetic assembly may generally include a fixed magnetic field element and a movable, rotatable magnetic field element which cooperate to alternately, first, engage and hold or secure the aperture closure member in closing position of said aperture, and second release and allow for opening of the closure member relative to the aperture. The invention further relates to an overall combination of an aperture and aperture closure member, such as a window or a door, the aperture being defined by a substantially fixed frame and the aperture closure member being a movable means such as a movable sash, said combination further including a securing device or system for alternately securing and releasing the aperture closure member relative to the aperture, e.g. for opening and closing of said aperture.

In the general embodiments shown in FIGS. 1-4, the combination or assembly of an aperture and a closure member therefore is generally identified with the reference numeral 10, the aperture being defined by a frame 12 and the closure member or window identified generally by the reference numeral 11. The combination 10 may be, as shown in the drawings according to a preferred embodiment of the invention, an openable window assembly 10 with a main, substantially stationary, or fixed frame structure 12 which includes a top member 5, a bottom member 6, and side members 7 and 8, and an openable sash structure 13 with a top member 1, a bottom member 2, and side members 3 and 4. The sash structure 13 carries a window pane 15 which together form the openable closure member 11 in the embodiments shown in the drawings.

By means of swing fittings or hinges 9, between the respective sash and frame side members 3, 4 and 7, 8; the sash structure 13 is pivotally journalled in the frame structure 12 with an axis of rotation which as shown, may be parallel with the top and bottom members and may be top or bottom hung or established substantially halfway between them by means of the pivotal fittings 9. Moreover, as is known, the rotatable sash 13 may be alternatively (or even alternately; see FIG. 4 described below) journalled about alternate fittings 9 at or about the top or bottom members, or alternatively (or alternately) at a position at or about and/or parallel to the side members.

In a closed position, the sash 13 and closure member 11 are oriented substantially parallel with and disposed within the window frame 12. In the closed position a securing and/or locking mechanism (alternatives of which being described further below) engages the sash 13 with the frame 12 to hold the sash 13 secure and/or locked closed relative to the frame 12. Note, in many preferred embodiments of window frames and corresponding sashes, a resilient and preferably circumferential gasket (not shown) is often provided between the frame 12 and the sash 13. The gasket is compressed when the sash is in the closed position in order to provide a substantially hermetic seal between the frame 12 and the sash 13.

Figure 2:
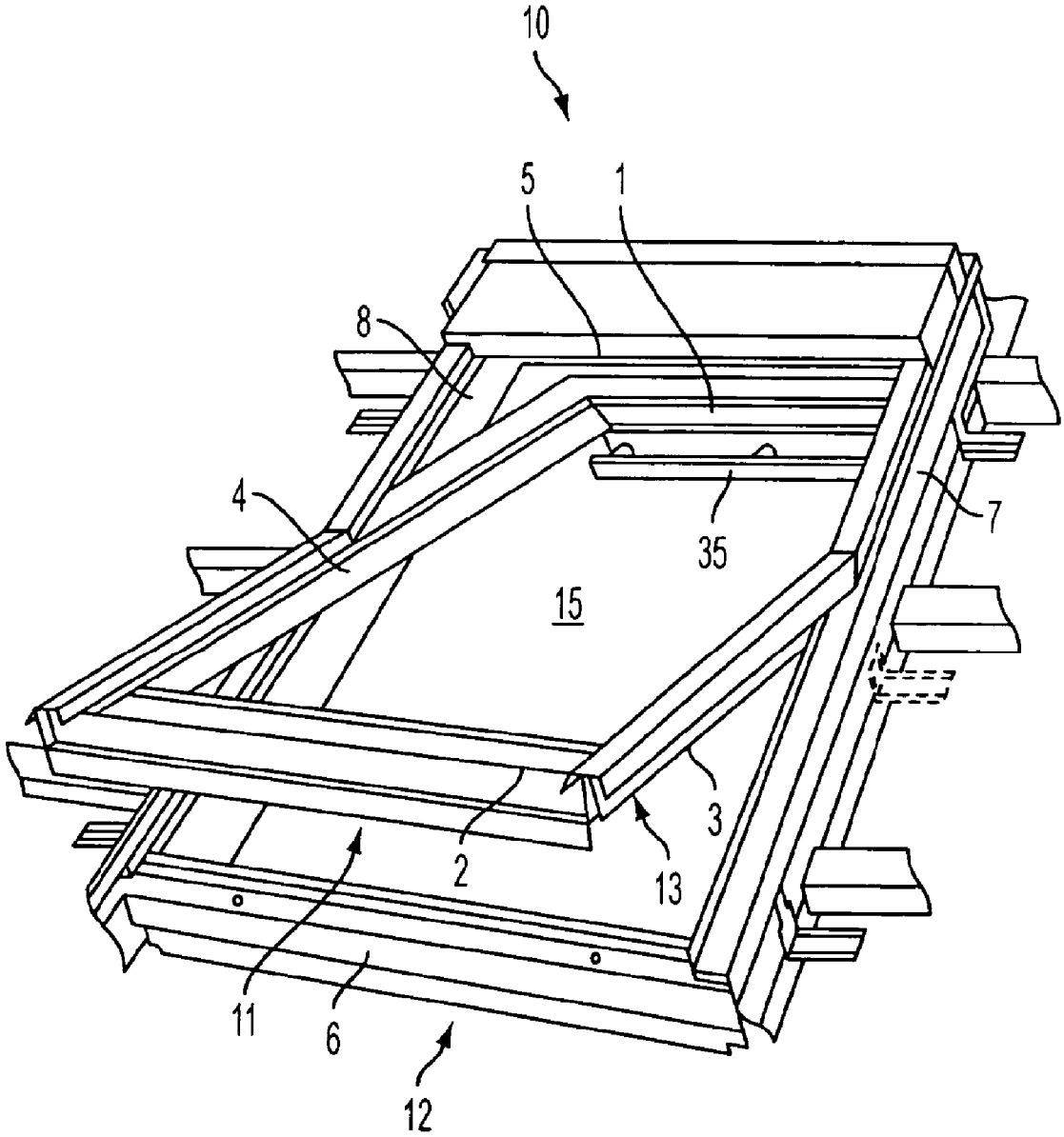
FIG. 2 is a further isometric view of an embodiment of a pivotal window according to the invention in an open position.
Figure 3:
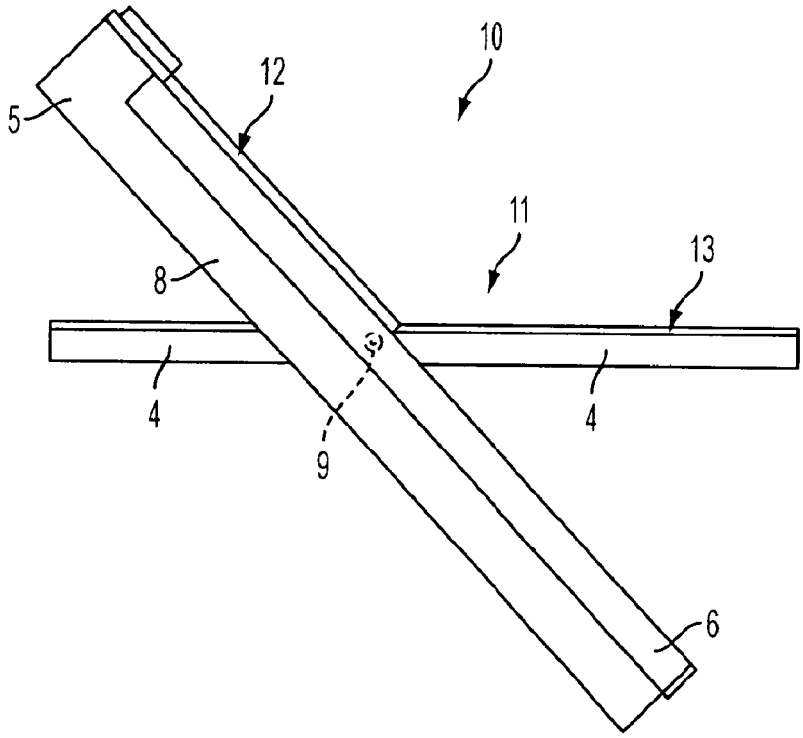
FIG. 3*a* is an elevational view of the sash and the frame along the longitudinal dimension of an embodiment of the invention.
Figure 4:
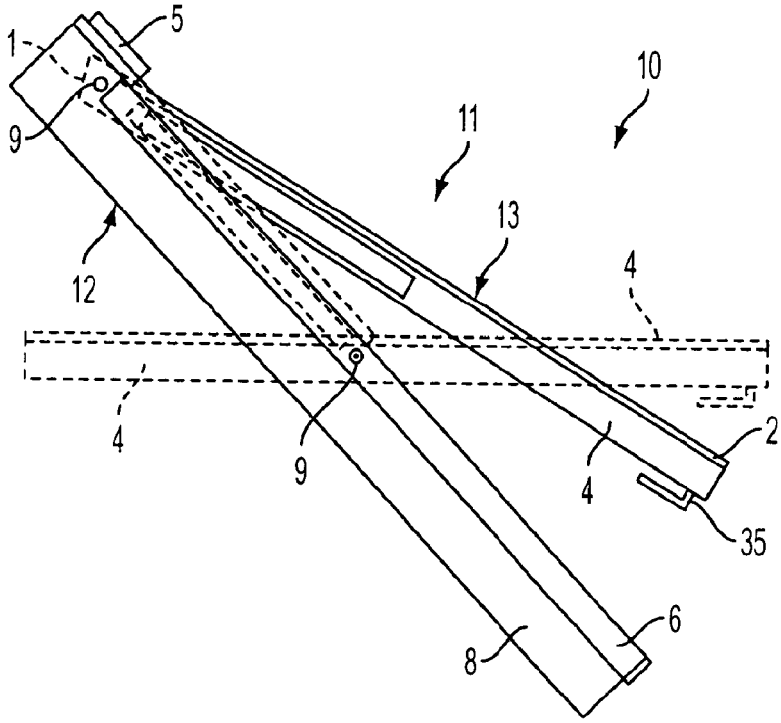
FIG. 4 is an elevational view of the sash and the frame along the longitudinal dimension of an embodiment of the invention.

In FIGS. 3 and 4, schematic side views of the window assembly 10 as a combined turn/pivot window are shown, in which the sash structure 13 and the window/closure member 11 under normal use may be either top-hung or substantially centrally pivotal relative to the frame structure 12, or both, alternately. Thus, both pivotal positions are shown in dashed lines in FIG. 4, with the central alternative shown in a solid line in FIG. 3. In either case, it may be that the window/closure member 11 may function as a pivot window which is openable and closable by means of an actuation member here shown, FIG. 4, represented by a control handle 35 on the interior side of the sash bottom member. Note, the control handle 35 may be top or bottom or otherwise situated, see, e.g., the top positioning generally indicated in FIG. 2.

To make it possible to swing the window sash through a large angle (e.g., as much as approximately 90 or even 180 degrees) to a convenient open position, the sash structure 13 may be pivotally connected with intermediate hinge members 9 often positioned between substantially centrally between the upper and lower parts of the sash and frame side members 3, 4 and 7, 8, respectively. Note, during normal use of the window, either the top-hung or centrally-disposed hinges may be used (as alternatively could bottom disposed or hinges disposed in the respective top and bottom members 1, 2 and 5, 6). The axis of rotation of the substantially central swingable connection lies approximately halfway between the top and bottom members in the same manner as shown in FIGS. 3 and 4, and operation of the window to this pivot or swing movement is carried out in a manner frequently used in connection with roof windows, inter alia. Herein described below, however, is a different actuation of the locking mechanism, which releases a locking mechanism positioned between the frame and sash top members.

First is a preferred push and pull handle assembly 35, which as shown in the drawings, see FIGS. 2, 3 and 4, may be disposed in a substantially horizontal disposition, i.e., operably parallel to the top and/or bottom members 1, 2 and 5, 6 of the sash and frame, and may be disposed at or adjacent the top members 1, 5 see FIG. 2, or may be disposed at or about or adjacent the bottom members 2, 6 as shown in FIGS. 3 and 4. Note also, though not shown (and perhaps less preferred), the handle bar assembly 35 could be disposed at various dispositions top to bottom horizontally, or the handle bar member 35, or the like could be disposed in a lengthwise position parallel with the side members 3, 4 and 7, 8, and adjacent one or the other sides 3, 7 or 4, 8. Even so, it should be noted that these alternatives may have a variety of functional distinctions or restrictions not required or impacted by the preferred top and/or bottom horizontal dispositions shown and initially described here.

In the primary embodiments described herein, the handlebar assembly 35 is connected to the movable sash 13, in many cases on or to the bottom or top member 1 or 2 as described further below. In such cases connected to the movable sash, the assembly 35 may act not only as an actuator for alternately engaging and disengaging the locking/securing device, but also for maneuvering the movable sash 13, i.e., alternately into open and closed positions. Unshown alternatives could provide for the handlebar assembly to be connected to the frame 12 for actuating the locking/securing device, but would likely lose functionality for maneuvering the sash and aperture closure 11 open and closed.

A first feature of a push/pull member 35 is in a first preferred interaction thereof with one or more locking or securing devices or assemblies hereafter referred to generally using the reference numeral 20. Details of such alternative locking or securing devices or assemblies 20 will be addressed below; but first; more description of a preferred push/pull handle bar assembly 35 will be described with particular reference to FIGS. 5-9, inter alia.

As shown in FIGS. 5-9, a handle bar assembly 35 is depicted separate from the window/closure member 11 on which it will preferably be disposed (see again FIGS. 2, 3 and 4 as described above). Such an assembly 35, in a preferred embodiment may include a bar 36, often an elongated bar 36, which has one or more, here three, connecting members 37 which operably connect the bar to the mechanical parts of the assembly 35. Such mechanical parts include generally as shown in FIGS. 5-9, one or more, here (FIGS. 5, 6 and 8), three gear box assemblies 38, which are mechanically connected to an elongated rotational rod 39. These parts, particularly the gear box(es) 38 may then be connected (as by nails or screws or other connection means) to the sash, see e.g., elongated horizontal sash member 1*a* or 2*a* (which could be a part of or comprise the entirety of the sash upper or lower member 1 or 2, see descriptions thereof above). The connecting bars 37 are disposed to move translationally back and forth within (e.g., telescopically in and out of) the gear boxes 38 (see the arrowheads in FIGS. 5 and 7-9) with alternate pushing and pulling forces applied to the bar 36. The rotational rod 39 may be disposed in rotational capacity within a receiving trough or other channel like feature 40 defined in the sash member 1*a* or 2*a*.

Also shown in FIG. 5, but to be described further below, is a magnetic securing device/assembly 20 and a cooperating frame fixture 41 to be affixed (as by screws, nails or other means) to a corresponding fixed frame member, e.g., either top or bottom frame member 5 or 6 (not shown in FIG. 5). The fixture having, for example, a magnetically receptive metal portion forming an anchor 42 for cooperating with the magnetic device, and/or an eyelet 43 or other hook receiving portion for receiving a securing hook 44, or the like, also described below. Note, the magnetically receptive metal portion 42 is generally active to be magnetically attractive to a magnet, and as such may itself be magnetic or merely of a material which is subject to magnetic forces.

Figure 6:
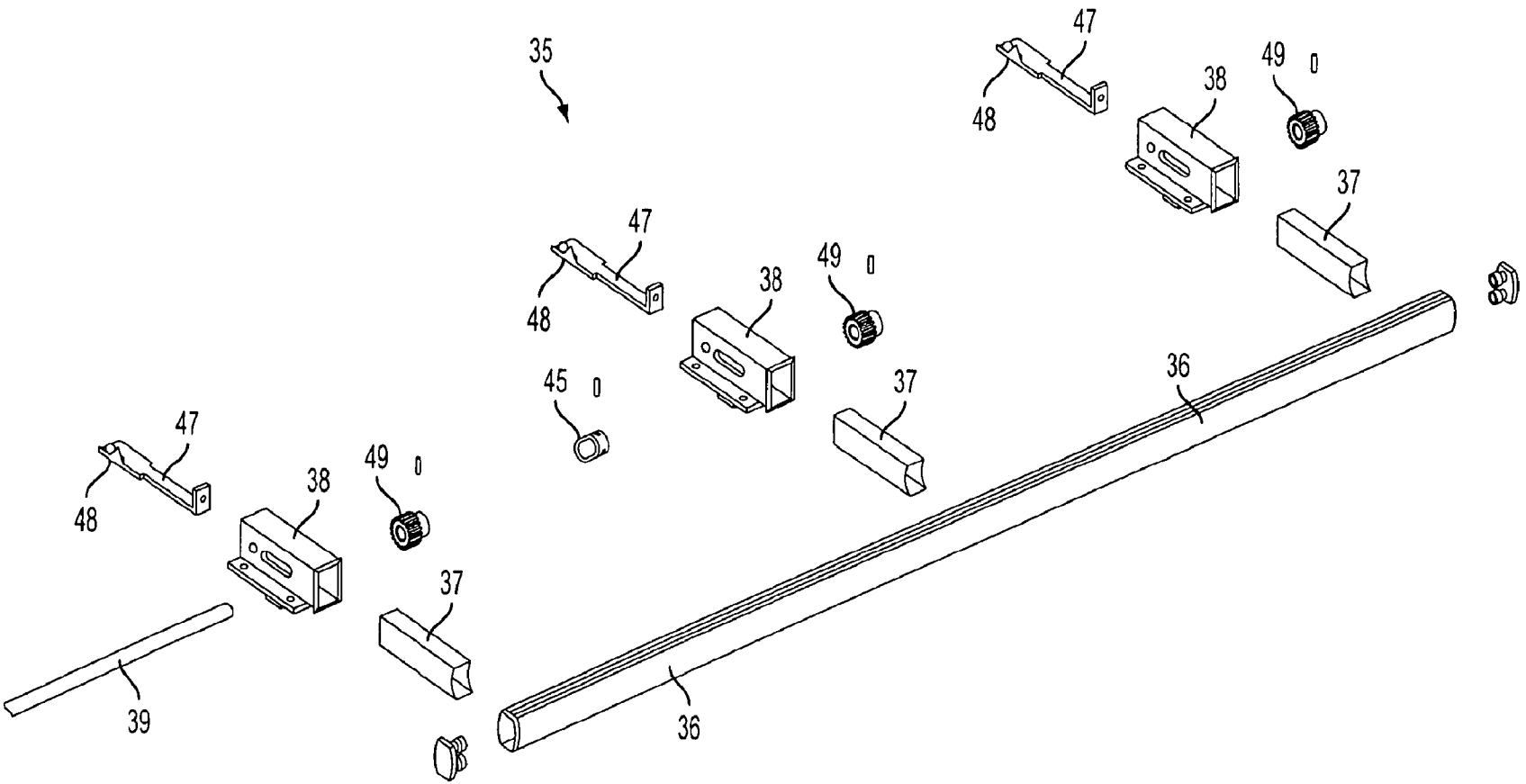
FIG. 6 is a further exploded isometric view of a push/pull handle bar assembly of the present invention, FIG. 7, which includes sub-part FIGS. 7A and 7B, provides elevational views of a push/pull handle bar assembly of the present invention.
Figure 7A:
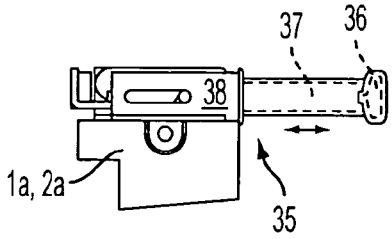
Figure 7B:
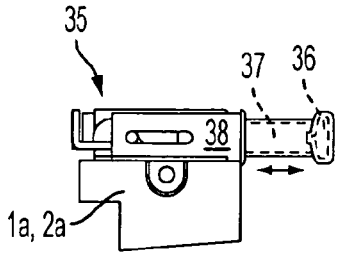
Figure 8:
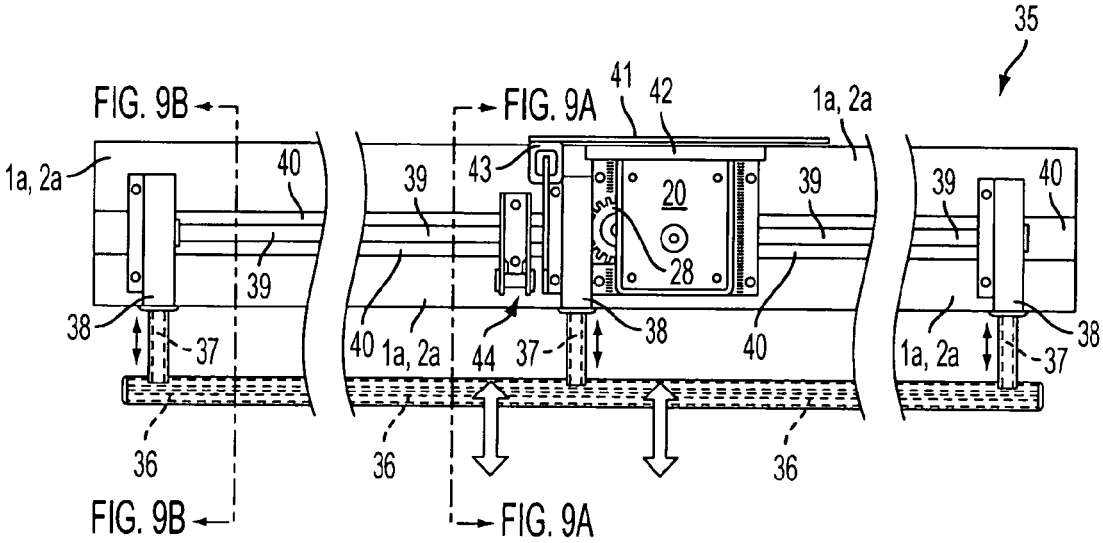
FIG. 8 is a partially broken plan view of a push/pull handle bar assembly of the present invention, FIG. 9, which includes sub-part FIGS. 9A and 9B, provides cross-sectional views of a push/pull handle bar assembly as taken from FIG. 8, the respective cross-sections taken on lines A-A and B-B of FIG. 8.

In slightly more detail, as shown in the exploded view of FIG. 6 and the plan and elevational views of FIGS. 7-9, within each gearbox 38 may be a gear rack 47 with gear teeth 48 (see also the close-up of FIG. 10) for engagement with respective gear pinions 49. The gear rack(s) 47 are in these embodiments connected to the respective connecting member(s) 37 and translationally movable therewith, also upon the imposition of motion-imparting forces, in and out, as such forces are applied to the bar 36. The respective pinions 49 are disposed fixed upon the rotational rod 39 (see e.g., the pins therefore in FIG. 6) and impart rotational movement thereto when gear-driven by the respective rack(s) 47. The cooperation of three rack and pinion movements about a rod 39 such as is shown here may help ensure a relatively even translational in an out movement of the bar assembly 35 regardless whether an uneven force may be applied thereto, as for example, more or less force being applied at or near one end or the other of the bar 36. As can be seen better in the close-up view of FIG. 10, the gear teeth 48*a* on the underside of the rack 47 are intended to coact with the pinion gears 49. The underside orientation is referred to for convention relative to the drawing only, and is not intended as a necessary limitation as upperside or sideways disposed orientations could also be functional within the limits of the present invention. Note, the side gear teeth 48*b* on one or more of the racks 47 are intended for an alternative function relative to the magnetic device 20 as described further below.

A further detailed mechanical part shown in FIG. 6 (see also FIG. 9A) is a cam latching member 45 which is also affixed to the rotational rod 39 (see the pin therefore in FIG. 6). The cam latching member 45 is operative with a hookpiece 44 as will be described further below.

Figure 10:
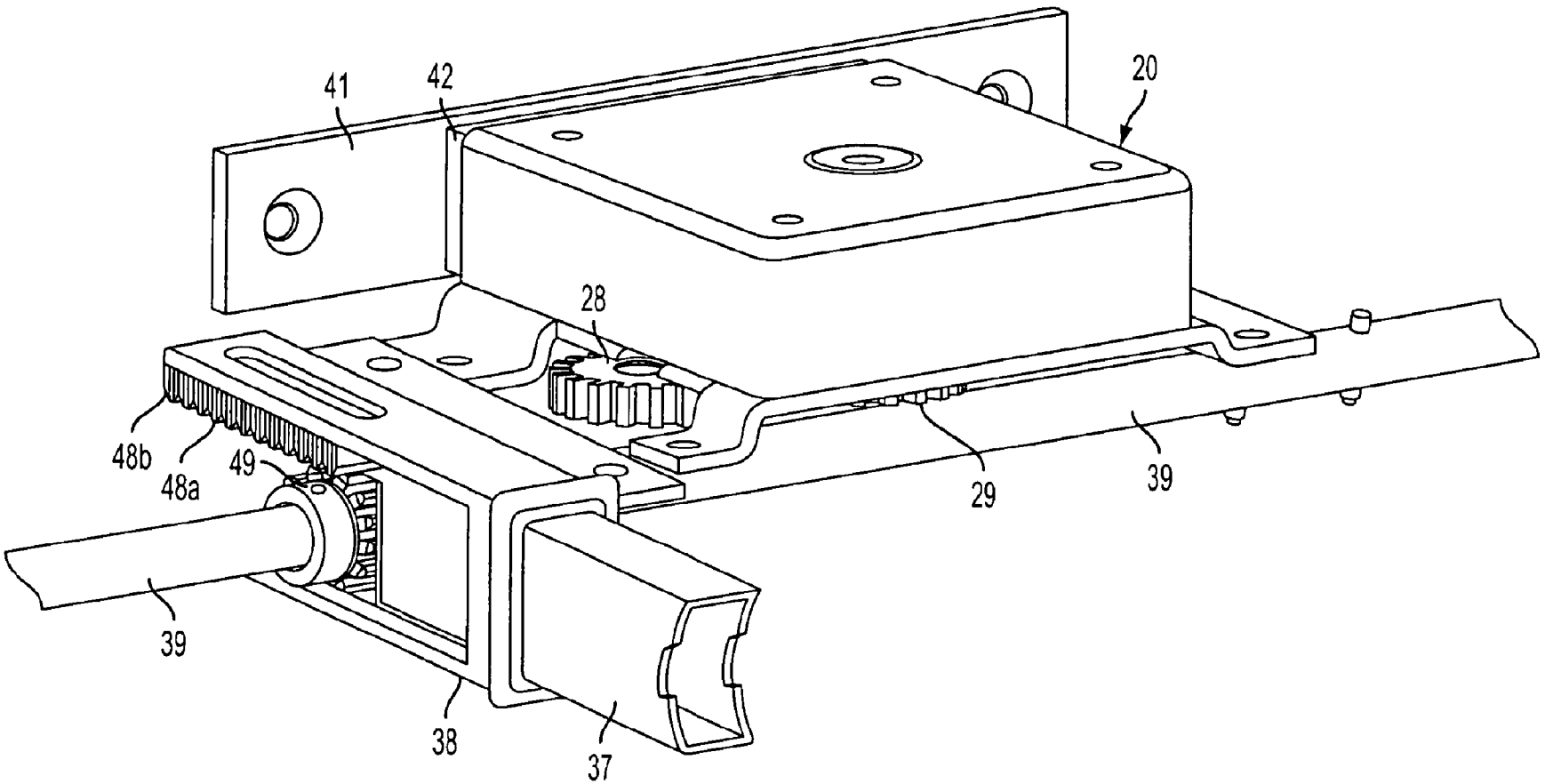
FIG. 10 is an isometric view of an isolated portion of a push/pull handle bar assembly and a locking/securing assembly of the present invention.
Figure 11:
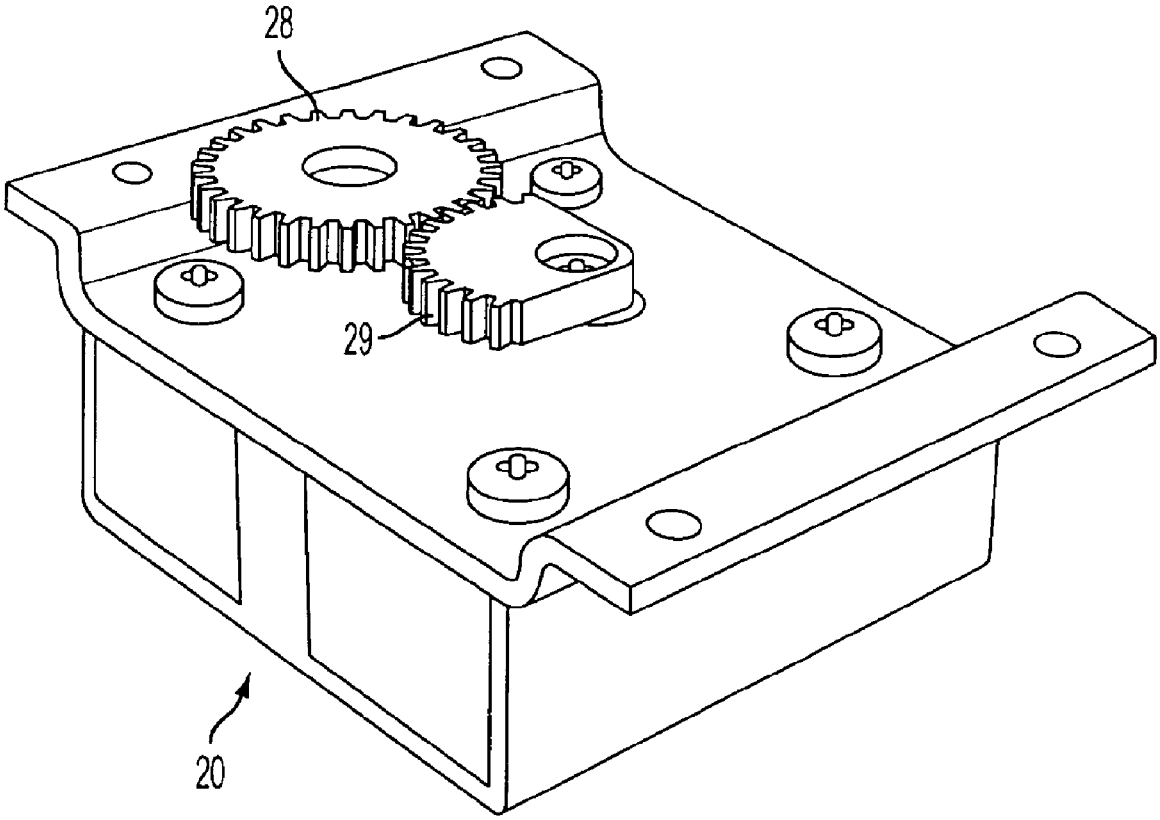
FIG. 11 is an underneath isometric view of a locking/securing assembly of the present invention.

Moving to a description of the interaction of the control handle assembly 35 with the locking and/or securing mechanisms or systems, shown in FIG. 10 (see also FIG. 9B) is a close-up view of a gearbox 38 with an internally telescopically movable connector 37 and rack 47 as disposed in a yet separated but relational view adjacent a locking/securing device 20, here of a magnetic type (see here also the frame fixture 41 and magnetic portion 42 thereof). Though not shown in FIG. 10, side gear teeth such as those teeth 48*b* depicted here, would engage the respective gear teeth of the gear 28 of the locking/securing device 20. In this case, the gear 28 would in turn mesh with and drive a further gear 29, which as shown in FIG. 11 (an underside view of the device 20), may be only a 90 degree gear, i.e., rotatable through 90 degrees, for a purpose to be more fully described here.

Figure 12:
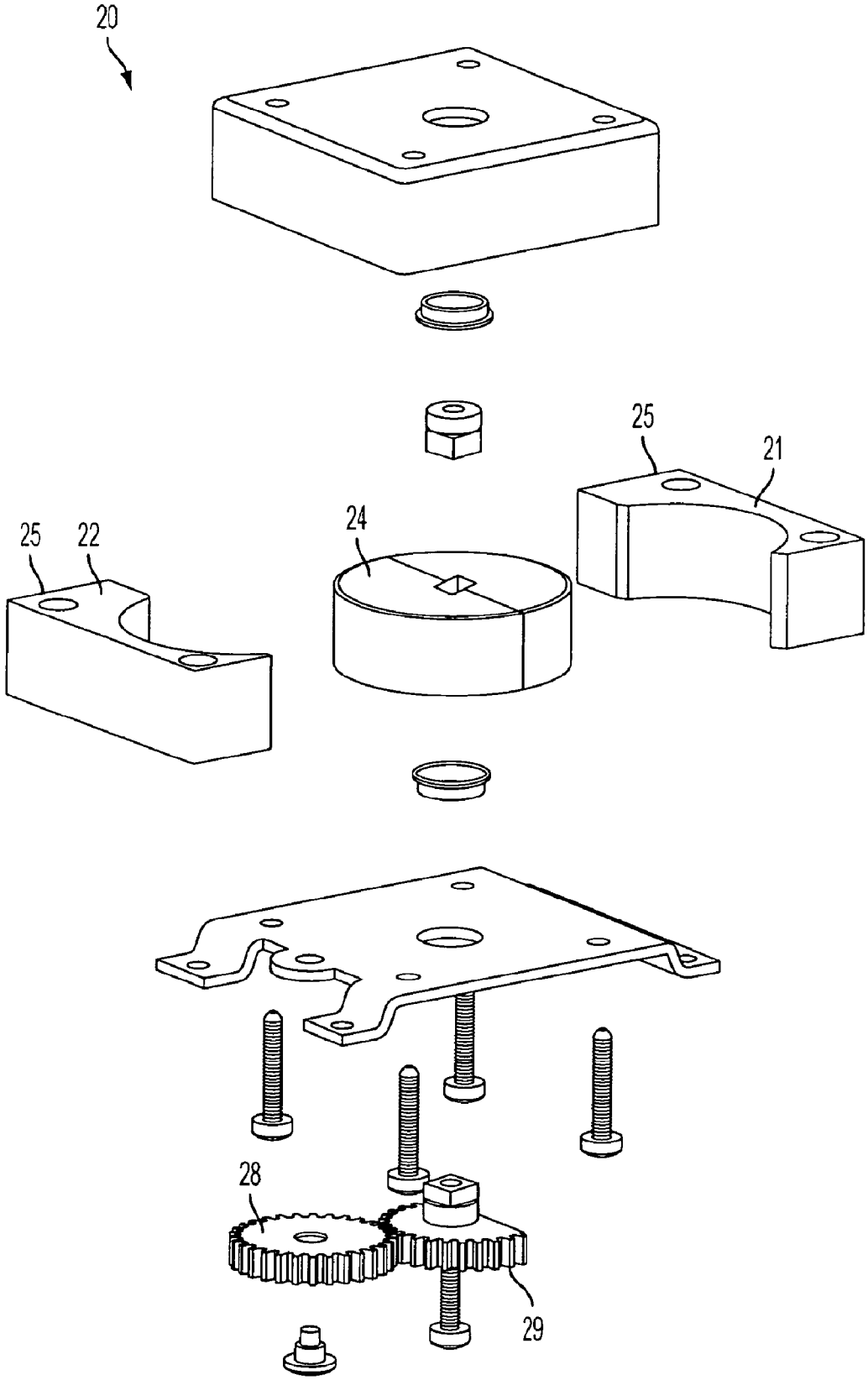
FIG. 12 is an exploded isometric view of a locking and/or securing assembly of the invention, FIG. 13, which includes sub-part FIGS. 13A and 13B, provides plan views of the operable internal parts of a locking/securing assembly as shown in FIGS. 10-12, for example, and, FIG. 14, which includes sub-part FIGS. 14A and 14B, provides underneath plan views of an alternative locking/securing assembly of the present invention.

As shown in FIG. 12, the driven 90 degree gear may be rotationally connected to a magnetic member 24 disposed within the assembly 20. Magnetic member 24 is an element which provides a magnetic field, as in some preferred examples, a permanent magnet (thus, the shading in FIG. 12 highlighting the separate and opposing north and south polarities thereof). See also FIG. 13 (as broken into sub-part FIGS. 13A and 13B), where the respective north and south poles are depicted using the N and S references. Magnetic member 24 is disposed within one or between two further magnetic members 21 and 22 also disposed within the device/assembly 20. As such, a magnetic assembly 20 may generally include a fixed magnetic field element or elements, here elements 21, 22 (note the two elements or their equivalent in a single structure may comprise a single magnetically activatable combination), and a movable, rotatable magnetic field element, here element 24 which cooperate to alternately, first, engage and hold or secure the aperture closure member 11 in closing position of said aperture, and second release and allow for opening of the closure member 11 relative to the aperture.

The specific operational features of a preferred magnet assembly 20, which may also be known as a mechanically deactivatable magnetic securing device 20, will now be described with more specific reference to FIGS. 13A and 13B. As shown there, the magnetic locking/securing assembly 20 has two magnetically active or activatable metal parts 21 and 22 which are coupled together within the assembly 20 with a separator layer 23 of non-magnetic-permeable material or space interposed therebetween. Parts 21, 22 are formed such that they define a magnetic circuit block or yoke (as will be described further below) with a circular cavity or hole therebetween into which a magnet 24, preferably circular in section, is slidably and rotatably inserted. The magnet 24 may be in cylindrical or columnar form, or in the form of a round thick disc (see FIG. 12) and has the N pole and the S pole respectively defined therein as introduced above. The base of the magnetic combination 20 may have a shallow indentation or groove, here shown as a V-shaped groove, cut in the bottom thereof between activatable surfaces 25, to provide an appropriate magnetic surface to seat against a surface to which it will magnetically adhere, see e.g., magnetically attractive member 42 from FIGS. 5, 8 and 10.

Figure 13A:
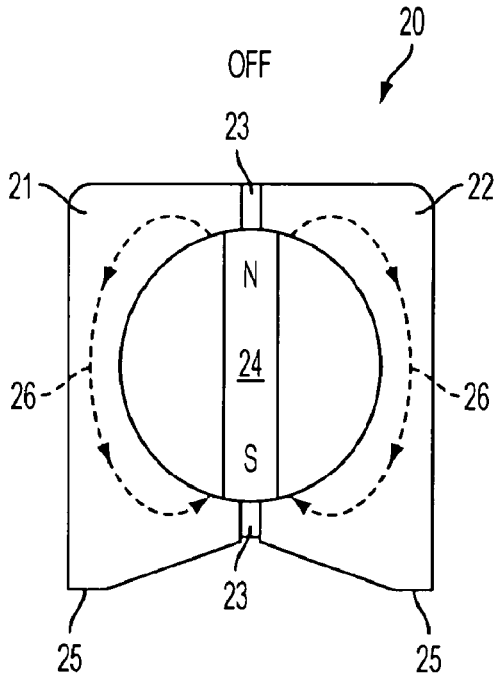
Figure 13B:
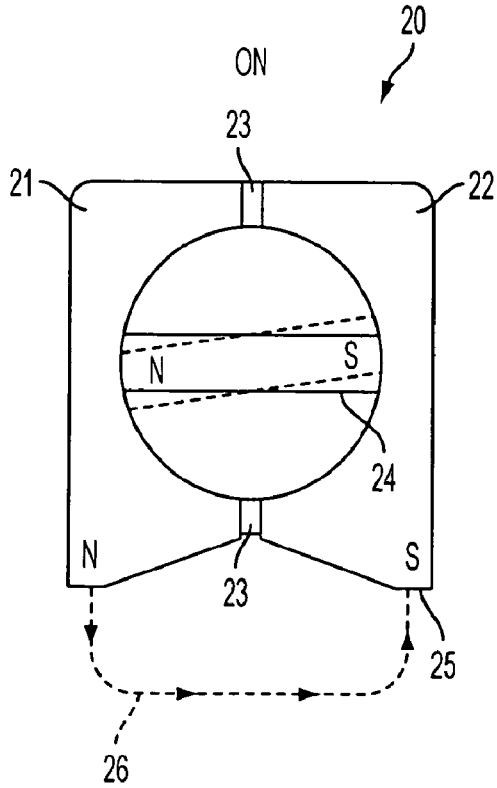

In operation, first the rotatable magnet 24 is set so that the diametrally opposite poles (N and S) are oriented as shown in FIG. 13A, i.e., the rotatable magnet 24 is placed in inactive (OFF) state. Under this condition, the activating surfaces 25 of the device 20 are initially magnetically inactive. These may then be moved or placed adjacent a magnetically attractive surface (e.g., surface 42, FIG. 5) against which the magnetic device will adhere. Then the unit 20 may be turned on by turning the central magnetic disk 24 through 90 degrees so that the N and S poles of the magnetic assembly 20 are placed in the orientation of FIG. 13B and are in active (ON) state. When the magnet 20 is in the active state, its magnetic flux 26 is extended outside the device 20 through the active surfaces 25 of the device as shown in FIG. 13B. Accordingly, when the magnetic assembly 20 is thus placed adjacent the magnetically attractive surface, and turned ON, it is magnetically attracted to the magnetic surface (e.g., surface 42), and, as a result, the magnet 20 is fixedly secured to such surface (e.g., surface 42 of the frame fixture 41).

In the case where the magnet is placed in the inactive state, the magnetic flux 26 is extended through the magnetic metal parts 21 and 22 as shown in FIG. 13A. Accordingly, no magnetic force for attracting the metal parts 21 and 22 to an aimed surface such as the member 42 (sometimes also known as an anchor 42 or armature 42) is produced.

Note, the side members 21, 22 may be magnetically conductive, or magnetic conductors, thus magnetically activatable, such as magnetic metals (Cr, Mn, Fe, Co, Ni, e.g.) or they may alternatively be permanent magnets, and then the magnetic flux 26 of the internal magnet 24 would be added to the flux of the magnetic members 21, 22 and thus passes through the magnetic surfaces 25 as indicated by a broken line arrow 26, thereby placing the surfaces 25 into an excited/activated state to engage the magnetically attractive frame surface 42.

In any case, contrarily, when turned OFF (i.e., back to the position of FIG. 13A), the magnetic flux 26 is extended through, or limited to the magnetic metal parts 21 and 22 of the assembly 20 as shown in FIG. 13A, and accordingly, no (or very limited) magnetic force for attracting the magnet 20 to an exterior surface is produced. Thus, when the rotational position of the magnet 24 is such that the two poles (N and S) are located at the open space (or nonmagnetic member) 23 as shown in FIG. 13A, the magnetic flux 26 of the magnet 20 is enclosed within the magnetic members 21, 22, and the magnetic surfaces 25 are not active.

When the fixture 41 is connected to the stationary frame 12 (at e.g., top or bottom member 5 or 6), the magnetic device 20 can secure or lock the window sash 13, via the top or bottom member 1, 2 thereof (whichever has the magnetic device connected thereto via member 1*a*, 2*a*, e.g.), to the frame 12. The magnetic force of the magnetic device 20 may be such as to strongly resist opening, thus locking the sash against the frame, or may be of limited strength (depending upon available materials, for example) and thus provide more relative securing of the sash against the frame. An auxiliary or alternative locking device 20*a*, or e.g., a hookpiece 44, may then be used as described below. In any case, the push and pull activation by the handle bar may provide greater simplicity in operation and actuation of the alternate securing/locking and then unsecuring/unlocking feature, simplifying the maneuvering necessary by the human operator to both engage and disengage, and/or reducing the forces needed to be applied by the human operator, and/or improving the overall ergonomics of the opening and/or closing of the closure member 11 relative to the aperture.

Note, as introduced, an auxiliary locking device may be used, e.g., for redundancy or to provide actual locking if the magnetic member 20 is not sufficiently strong to lock (e.g., rather secure) the aperture closure member in closed position by itself. Alternatively, such an auxiliary locking member can be used in lieu of a magnetic assembly 20. As shown in FIGS. 5, 6, 8 and 9A, though perhaps best seen in FIGS. 5 and 9A, the magnetic lock 20 may be used with an auxiliary locking device, particularly a latch or hook 44, thereby providing a stay device plus a lock device. The auxiliary locking member or mechanism, e.g., a latch 44, can be fixed to the sash and engage with the window frame and may additionally be operated by a handle 35. Latch 44 may be controlled by the gearing system described above, the latch 44 being arranged to extend out from the opposite side of the sash from the handle and being adapted to extend into a recess or eyelet 43 connected to or within the frame 12 as for example in either upper or lower member 5 or 6 (or in the respective side member 7 or 8) to secure the sash against undesired opening.

Figure 5:
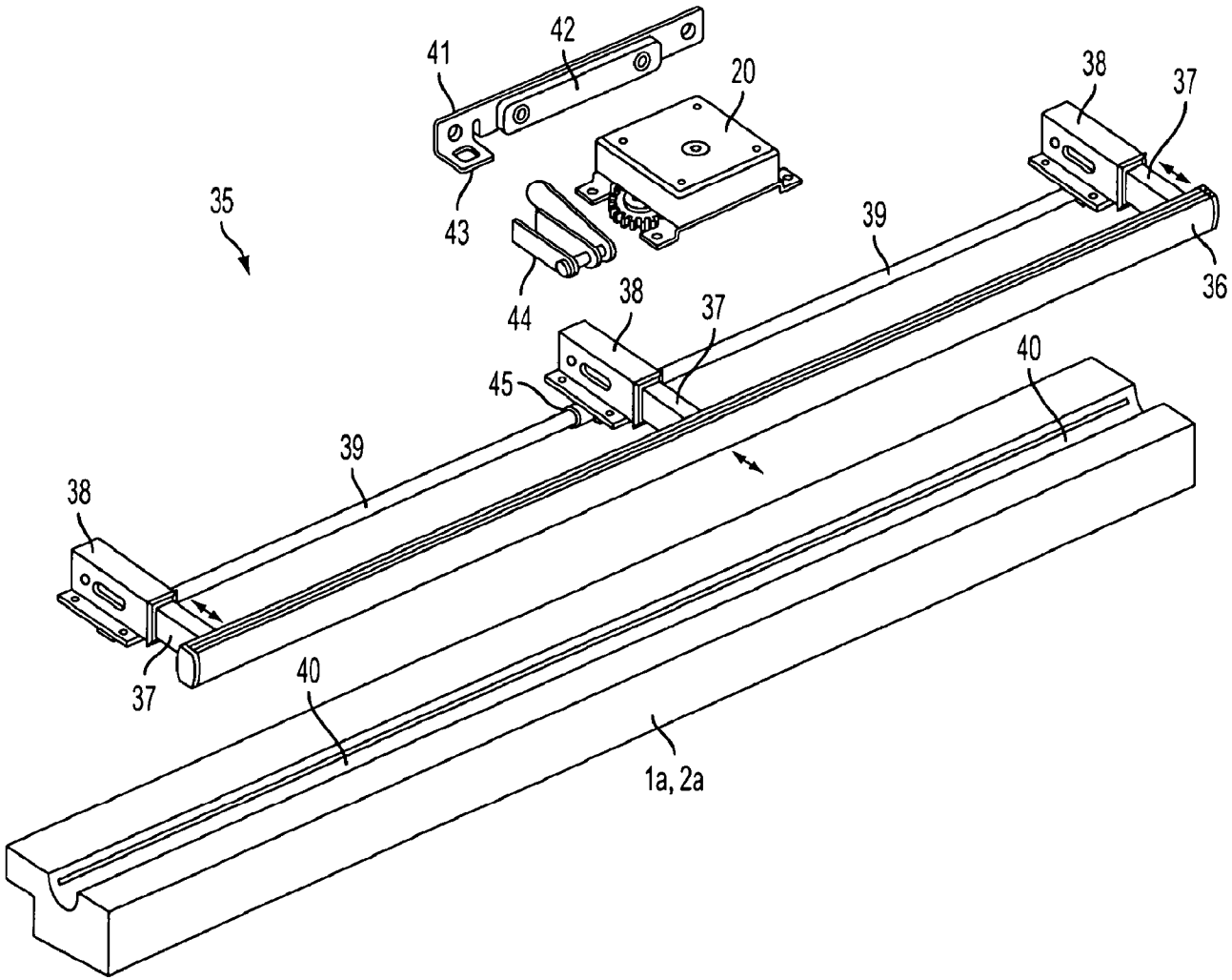
FIG. 5 is a partially exploded isometric view of an actuation handle bar and a locking and/or securing assembly of the invention.
Figure 9A:
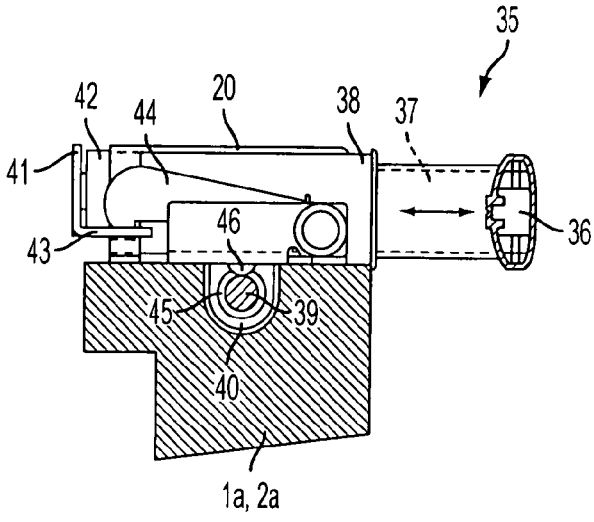
Figure 9B:
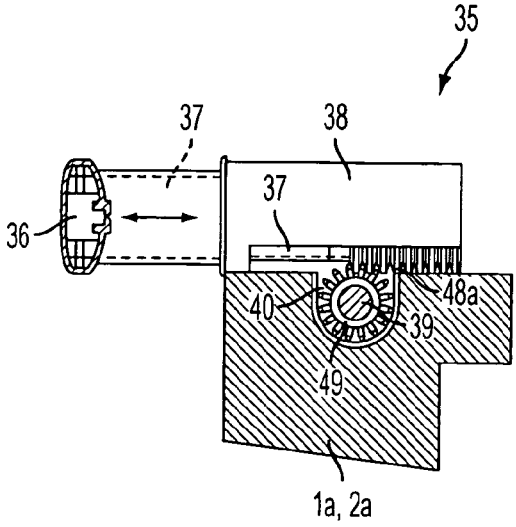

In more particular detail, a latch 44 may be biased, as by a spring (see e.g., FIG. 8), into a locking/latching position wherein the hook thereof would engage the recess or eyelet 43 (FIGS. 5, 8 and 9A). Then, the latch 44 may be rotatably movable against the spring bias, particularly as by engagement of a nub 46 on the latch 44 by a cam-like extension of a latch-engaging mechanism 45 on the rotatable rod 39 (see particularly FIG. 9A), where upon rotation of the rod 39 (as by the translational movement of the bar assembly 35, converted to rotational movement of the rod 39 by the rack and pinion 47/49 operation), the extended camming portion of the engaging mechanism 45 regularly impacts or rather contacts the nub 46 causing the latch 44 to lift and disengage from the eyelet to unlock the window. Note, such a latching assembly can be used with or without a magnetic assembly 20 and can in either case be activated/actuated by the push/pull handlebar assembly 35.

Note, when a sealing gasket (not shown) is used as a sealing member between the frame and the sash, a considerable amount of force can often be necessary to be applied by a securing mechanism, such as a magnetic locking device 20 as shown and described here, to ensure that the gasket is properly and fully compressed for sealing. In the closed position, the contrary repelling force of the gasket that urges the sash toward an open position (caused by the resilient pressure of the gasket exerted by the gasket on the sash 13) is preferably fully counteracted by the magnetic securing device 20 (i.e. the mechanical lock, including e.g. the latch 44, is preferably not loaded at any time by the force caused by the compressed gasket). In operation, the magnetic lock first overcomes the pressure of the gasket and thereafter the latch 44 catches the eyelet 43 when the sash is locked. When the sash is opened, the order may preferably be reversed, so that the latch 44 may disengage the eyelet 43, whilst the magnetic lock still withstands the force exerted by the gasket onto the sash. The magnetic lock may then complete its turning to disengaging position after the latch has disengaged the eyelet (note, though both are actuated simultaneously, the latch may be disengaged more quickly due to the smaller moment necessary for engagement/disengagement). There is thus practically no load on the mechanical lock, e.g., latch 44. Even so, by the nature of the relatively simple motion required to turn the magnet 24, the force required to alternately activate and deactivate the magnetic lock is also very low. Consequently, the force that a user needs to apply to the handle bar to alternately engage and disengage and engage the sash is very low, thus adding to user ergonomics and/or comfort.

Figure 14A:
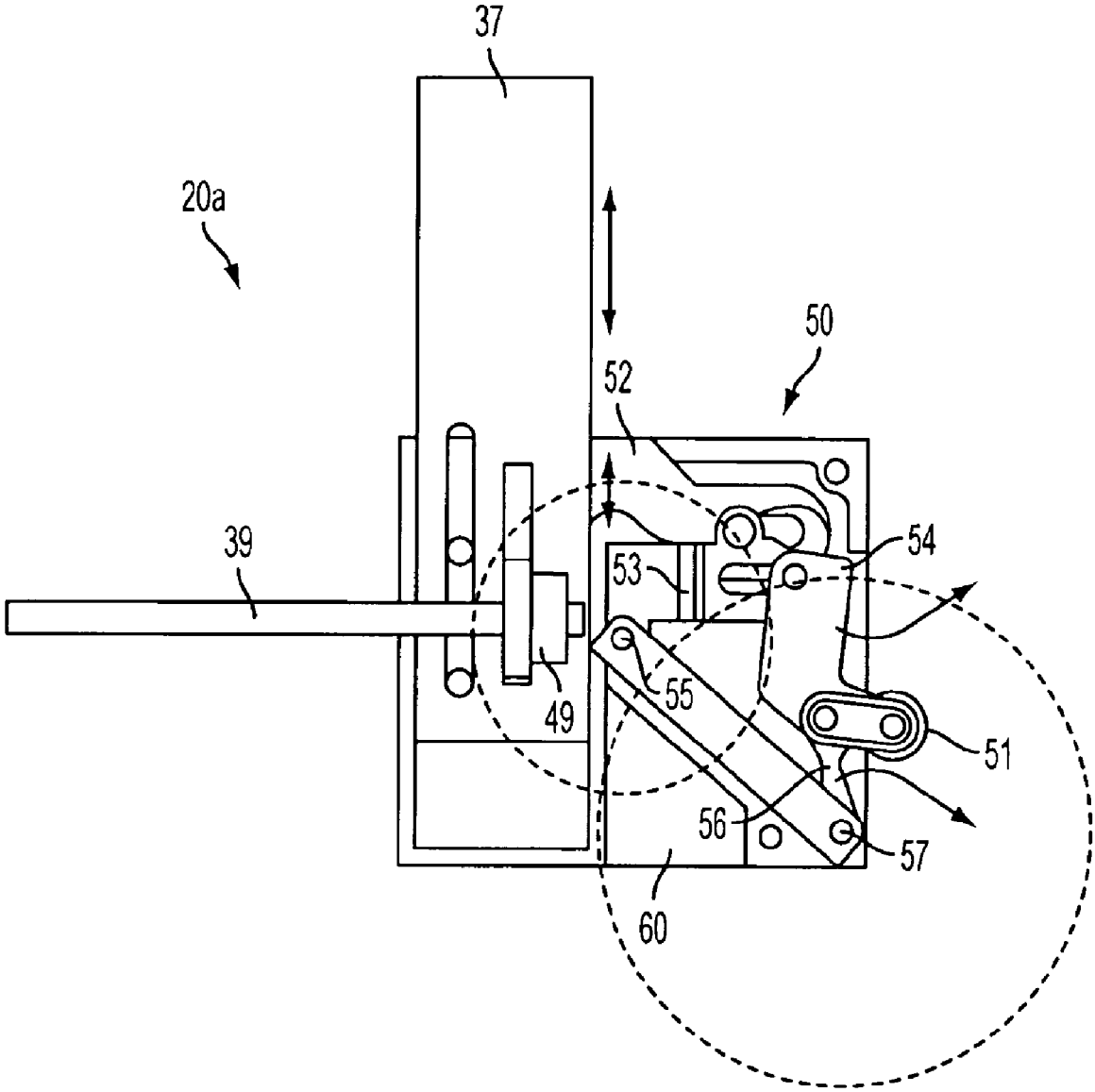
Figure 14B:
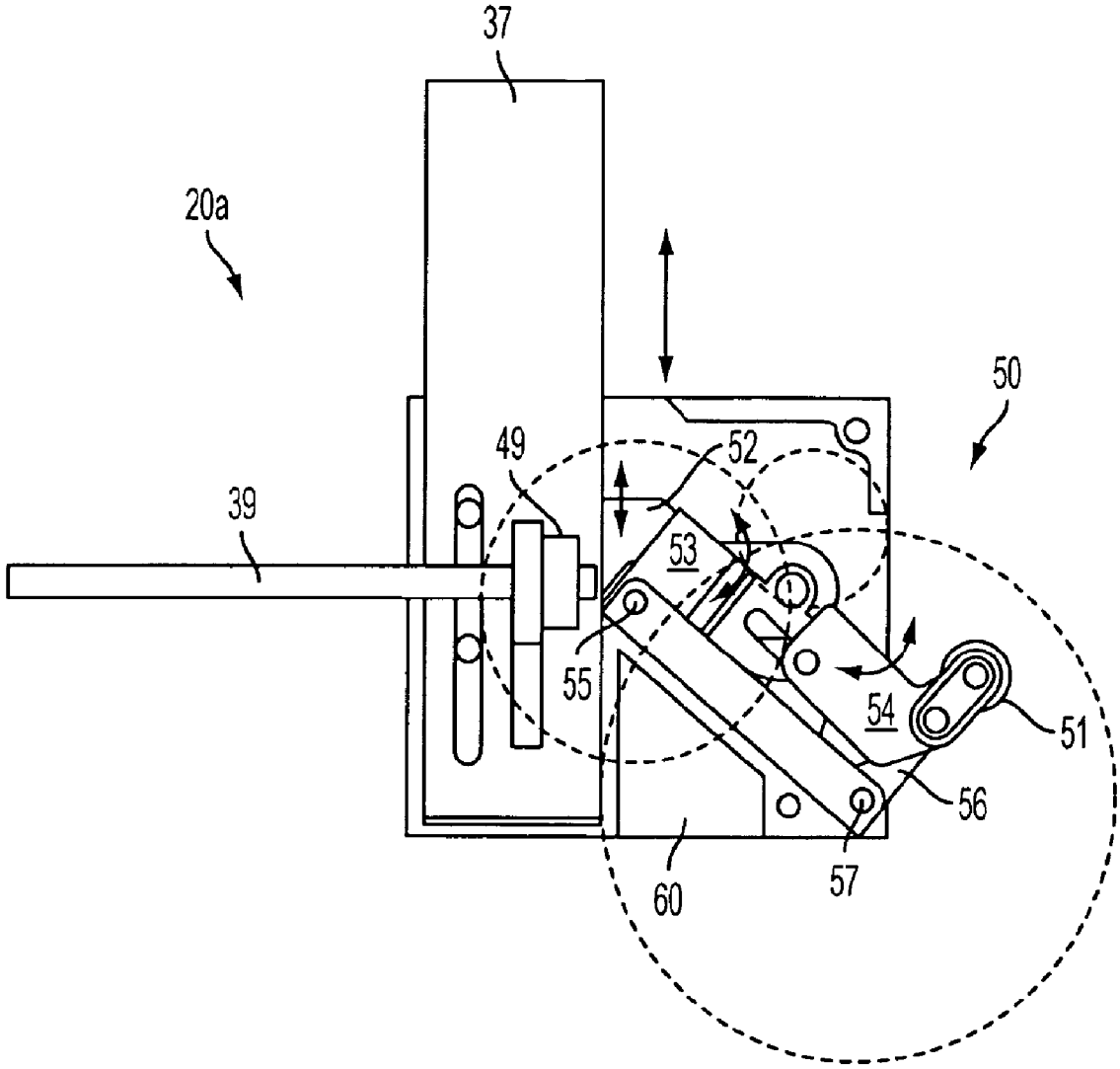

Other alternative locking devices are also potentially useful herein/herewith. In FIGS. 14A and 14B, an alternative embodiment of a locking device 20*a* is shown which is usable with and activatable by a translational activation, as by a parallel handle bar 35. As such the alternative embodiment 20*a* may be a fully mechanical lock operable alone or with another securing mechanism such as the magnetic assembly 20 described above.

In more details, the alternative lock 20*a* hereof is operable with the push bar assembly 35, being operably connected to at least one connection member 37. Note, the rotatable rod 39 and pinion 49 are shown, though are not necessarily involved in the operation of lock 20*a*. Rather, a system of linkages 50 are used to move the latching hook 51 into and out of locking position. Note, the locking position here shown is sideways, thus would lock into a recess or striking plate in/on the side members 7 or 8 of the fixed frame 12. Referring first to FIG. 14A, the translational movement of the bar assembly acting through the connection member 37 would then translationally move a member 52 connected thereto. Then, the member 52 forces a pivotal movement of a further linkage member 53 which pivots about the pivotal connection 55 thereof to a housing 60. Pivotal movement of the member 53 then forces pivotal movement of a further linkage 54 which together with a still further linkage 56 pivots the hook 51 outward (see the arrows in FIG. 14A). Linkage 56 pivots about a fixed pivot point 57 also connected to the housing 60. Then, the full extended, locked position is reached as shown particularly in FIG. 14B. Note, the hook 51 may be a rotatable member as shown to ease its interaction with the projection, recess, eyelet or other striking plate member with which it interacts to lock the device in closed position. Moving in reverse, the connecting member 37 moves back and pulls the member 52, which pulls the linkage 53 which rotates in reverse and in turn pulls the linkage 54 into retracted position as shown in FIG. 14A. In another variation the linkage mechanism may include belt rolled onto a shaft and with its end or ends connected to the connector 37.

As to ultimate uses, it may be noted that the window construction of the primary embodiments is a pivot window for installation in an inclined roof, however, the window or other aperture closure member may be installed in any of various orientations in/on a building or other situs for closing a respective aperture. Moreover, though pivotal or rotatable closure members (windows or doors) have been shown and described, other closure members which can be sliding or otherwise movable may also be used herewith. Moreover, any or all forms of windows and doors or other aperture closure members, e.g. also the door of a utilitarian appliance such as a refrigerator, washing machine, dryer or dishwasher may alternatively also make use of the securing means of the present invention.

Similarly, it should be noted that the magnetic lock or the other locking devices could alternatively be activated without the push/pull member as such, and instead be operated with a rather simple handle such as a rotatable handle or even a hand or finger size rotationally or translationally movable handle. Note for example that the magnetic device 20 has an axle emanating therefrom (see the bottom views, wherein the gear 29 rotates an axle connected to the magnet 24) which could be adapted to connect with and be turned by a hand-operable rotatable actuation member or handle. Such an axle could alternatively emanate from the top side of the device 20 for such a handle. Note, hand or finger size rotational or translational actuators could be used to initiate movement of the magnet 24 using a rack and gear combination 47/28 as above, and/or could activate the latch activator and nub combination 45/46 of the latch 44, and/or could move the linkage system 50, via the initial link 52, translationally to activate the other link members thereof. As above, these alternatives may be used each alone, separately, or in any of various combinations.

Moreover, it may be that an electronic switch and/or remote control may be used to activate the mechanical movement of a securing/locking device hereof, as for example, the initiation and movement of the magnetic member 24 of the locking/securing device 20. Similarly, an electronic switch and/or remote control could be used to activate the movements necessary for movement of the other respective locking/securing devices hereof, e.g., devices 20*a* and 44.

Preferably, the top, bottom and side members of the frame and sash structures may for the major part be built using wood products, although it is also possible to use metal or plastic. These profiles, particularly those which may be exposed to the weather may also be covered with covering members which are constituted of comparatively thin metal sheet profiles, for instance of aluminum, and which together may provide a completely weather-shielding enclosure of the window. Preferably the hinge(s) 9 and the operable securing/locking means 20, 20*a* and/or 44 may be made from metallic material, such as steel, or strong plastic materials, such as fiber reinforced plastics or combinations thereof, the primary exceptions being the magnetic and/or magnetically activatable members which may be of magnetic materials. The handle bar assembly 35 may additionally and/or alternatively be made from various combinations of materials including, without limitation, wood, metals and/or plastics.

Although the present invention has been described in detail for purpose of illustration, it is understood that such detail is solely for that purpose, and variations and combinations can be made therein by those skilled in the art without departing from the scope of the appended claims.

The invention claimed is:

1. An assembly for securing an openable aperture closure member (11) in a closed position relative to an aperture defined by a main frame (12), comprising:

a rotatable magnetic field element (24) for securing said closure member (11) to the frame (12); and a push and/or pull actuation assembly (35) for easing the securing or releasing process for the aperture closure member, the actuation assembly including a handle bar (36) and at least one connecting member (37) which operably connects the handle bar (36) to said rotatable magnetic field element (24);

wherein said handle bar (36) is translationally movable by an operator and translational movement of the handle bar moves the connecting member (37) to generate rotational movement of said rotational magnetic field element (24);

wherein said rotatable magnetic field element (24) is rotatable within a substantially stationary magnetically conductive element (21, 22), the rotatable magnetic field element (24) being cooperative with said stationary magnetically conductive element (21, 22) to alternately create and eliminate a magnetic field to co-act with a magnetically attractive fixture element (42) positioned on the frame (12) to alternately hold and release said closure member (11) relative to the stationary frame (12);

wherein the rotatable magnetic field element (24) is adapted to be operably engaged by a gear-toothed activation member (28) which is adapted to operably transmit forcing movement to the rotatable magnetic field element (24).

2. An assembly for securing according to claim 1 characterized in that the substantially stationary magnetically conductive element (21, 22) includes a substantially stationary magnetic field element (21, 22), the rotatable magnetic field element (24) being rotatable within the substantially stationary magnetic field of the substantially stationary magnetic field element (21, 22), the rotatable and stationary magnetic fields of the respective rotatable magnetic field element (24) and the substantially stationary magnetic field element (21, 22) being cooperative with each other to alternately securely hold, and then release the closure member (11) with respect to the stationary frame (12).

3. An assembly for securing according to claim 1 characterized in that the substantially stationary magnetically conductive element (21, 22) includes one of one or two members (21, 22), wherein two members are separated by a non-magnetically conductive layer.

4. An assembly for securing according to claim 1 wherein the substantially stationary magnetically conductive element (21, 22) includes one of one or two substantially stationary permanent magnetic elements (21, 22).

5. An assembly for securing according to claim 1 wherein the rotatable magnetic field element (24) is a rotatable permanent magnet (24).

6. An assembly for securing according to claim 1 characterized by further comprising an auxiliary rotational locking means (44, 54) for locking the closure member (11) to the frame (12).

* * * * *